United States Patent [19]

Murakami et al.

[11] 4,314,861

[45] Feb. 9, 1982

[54] MANUFACTURING METHOD OF ELBOWS MADE OF CAST STAINLESS STEEL

[75] Inventors: Shinichi Murakami; Hisakatsu Nishihara; Arata Yoshimitsu; Sueyoshi Noji, all of Hirakata, Japan

[73] Assignee: Kubota Ltd., Osaka, Japan

[21] Appl. No.: 155,187

[22] Filed: Jun. 2, 1980

[30] Foreign Application Priority Data

Jun. 5, 1979 [JP] Japan ..... 54-70843

[51] Int. Cl.[3] ..... C22F 26/00

[52] U.S. Cl. ..... 148/12 E; 148/2; 148/12 EA

[58] Field of Search ..... 148/12 R, 12 E, 12 EA, 148/2

[56] References Cited

U.S. PATENT DOCUMENTS 3,979,231 9/1976 Gondo ..... 148/12 R 4,018,634 4/1977 Fencl ..... 148/12 R

*Primary Examiner*—W. Stallard

*Attorney, Agent, or Firm*—Oblon, Fisher, Spivak, McClelland & Maier

[57] ABSTRACT

A method of refining the structure of the straight tube portions at the ends of an elbow made of cast stainless steel characterized in that a cast stock tube of a cast austenitic stainless steel with its chemical composition so adjusted as to have the ferrite phase mixed in in the proportion of 5-40% is formed, with the straight tube portions at its ends made larger or smaller than the specified dimension; the said straight tube portions are formed roughly to the specified dimensions by subjecting them to a plastic deformation either by a process of contraction or expansion, and thereafter, the tube thus formed is heated at 1,000°-1,200° C., and then, quenched.

5 Claims, 17 Drawing Figures

MANUFACTURING METHOD OF ELBOWS MADE OF CAST STAINLESS STEEL

BACKGROUND OF THE INVENTION

The present invention relates to a manufacturing method of elbows made of cast stainless steel, such an elbow provided at its ends with straight tube portions, for use in piping applications involving high temperatures and pressures and severe corrosion, and it provides a method for refining the structure of the straight tube portions at the ends of the elbow.

For piping elbows for use at high temperatures and pressures and under highly corrosive conditions, as in atomic power plants or in petrochemical plants, etc., for example, austenitic stainless steels, such as 18-8 series stainless steels, are now frequently in use. Such elbows may be manufactured either by casting or by forging.

Of these two methods, the use of casting is advantageous in that the adjustments of alloy components to meet the applications requirements are simplified, and that arbitrary shapes required for pipings may be produced. That's why this method is very popular, but such cast stainless steels are disadvantageous in that their crystal grains become coarse, giving rise to a low response to the ultrasonic-flaw test (hereinafter referred to as UT). This leads to a deplorable situation today when the growing importance of the in-service inspection at real plants (hereinafter referred to as ISI), for example, is recognized. Thus low response to the UT hinders adequate inspections for flaws such as cracks, etc., causing uncertainty in ensuring safety. As a countermeasure, crystal grain refinement by way of die casting, etc., are being tried. However, their inadequacy, as compared with the use of forging, can hardly be denied.

On the other hand, in the case of forging, due to the refinement of crystal grain, the response to UT in ISI is improved, but its use involves a variety of problems. Generally, austenitic stainless steels (e.g., AISI 304 or 316), having single phase structures of austenite, are highly susceptible to inter-granular corrosion (hereinafter referred to as IGC) or stress corrosion cracking (hereinafter referred to as SCC) where they are exposed to the welding heat. Actually, their use is not prohibited, but is greatly restricted. Where forging is applied, the methods commonly employed in manufacturing elbows are by the mandrel method or by assembling by welding after bending a plate. By these methods, the elbow 1 is bent from end to end; such an elbow 1 as shown in FIG. 2 which has straight tube portions 2 at both ends thereof can not be obtained. This straight tube portion 2 at the elbow end, as it is welded at 4 to the straight pipe 3, is the indispensable part in ensuring the accuracy in ISI by way of UT. Accordingly, a forging showing high response to UT will fail to meet the applications requirements, if it has no straight tube portions 2 formed thereon.

As described in the foregoing, in actual situations with piping elbows for uses involving high temperatures and pressures and corrosion conventional castings and forgings, having both merits and demerits, have given no assurances for proper safety (potential for accident prevention and high response to UT in ISI) under rigorous service conditions.

SUMMARY OF THE INVENTION

The object of this invention is to provide a manufacturing method of elbows made of stainless steels for uses involving high temperatures and pressures and corrosion, which is a new method having both advantages of casting and forging, and by which safety is assured.

The present invention is characterized in that a tube formed roughly to the specified dimensions, with its ends plastically deformed, is obtained by subjecting to a plastic deformation by contraction or expansion at the straight tube portions at the aforementioned ends a cast stock tube made of an austenitic stainless steel with its chemical composition so adjusted as to have the ferrite phase mixed therein in the proportion of 5–40%, and with the straight tube portions at its ends formed larger or smaller than the specified dimension; thereafter, the said tube with its ends plastic deformed is subjected to a heat treatment of heating at 1,000°–1,200° C. followed by quenching, thereby refining the structure of the straight tube portions at the ends of the elbow made of stainless steel.

BRIEF DESCRIPTION OF THE DRAWINGS

FIGS. 5, 5*a*, 5*b* and 5*c*, and FIGS. 6, 6*a*, 6*b* and 6*c*, denote views for explanation of the forming by contraction of the stock tube, FIG. 5*c* and FIG. 6*c* being sectional views along the line A—A in FIG. 5*b* and the line B—B in FIG. 6*b*, respectively;

DETAILED DESCRIPTION OF PREFERRED EMBODIMENTS

In manufacturing elbows made of stainless steels by the method of this invention, and later described in detail, using as the stock material, cast austenitic stainless steels, not of a single phase of austenite, but so adjusted as to contain the ferrite phase in their structure in the proportion of 5–40%, first, a cast stock tube with straight tube portions provided at its ends, the said straight tube portions being formed with a diameter larger or smaller than the specified dimension, is formed; then, the straight tube portions at the ends of this stock tube are subjected to a plastic deformation by contraction or expansion, thereby obtaining a tube with its ends plastic deformed, the part of which other than the straight tube portions at its ends and the tapered portions remains in the state of original casting, while the straight tube portions at its ends are formed roughly to the specified dimensions by the plastic deformation; thereafter, this tube is subjected to solution treatment doubling as the recrystallization heat treatment of heating at 1,000°-1,200° C. followed by quenching, thereby refining the crystal grain of the straight tube portions at the ends.

Figure 1:
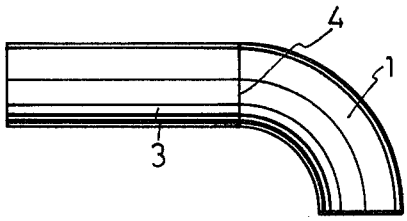
FIG. 1 depicts a front view illustrating the connection between the bent tube elbow and the straight pipe.
Figure 2:
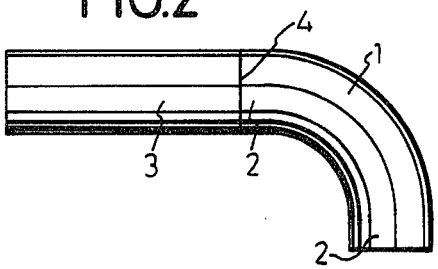
FIG. 2 designates a front view illustrating the connection between the straight pipe and the elbow having straight tube portions provided at both ends thereof.
Figure 4:
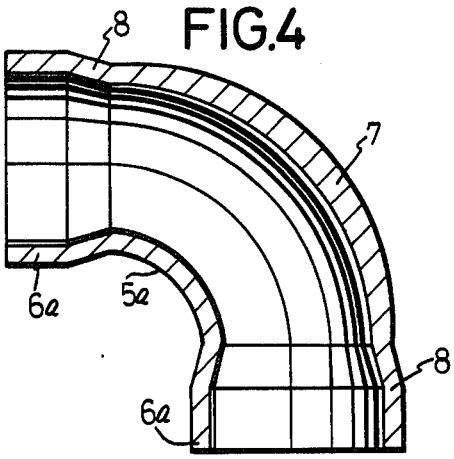
FIG. 4 gives a sectional view of this 90° elbow showing the shape of the stock tube to be formed by contraction.
Figure 3:
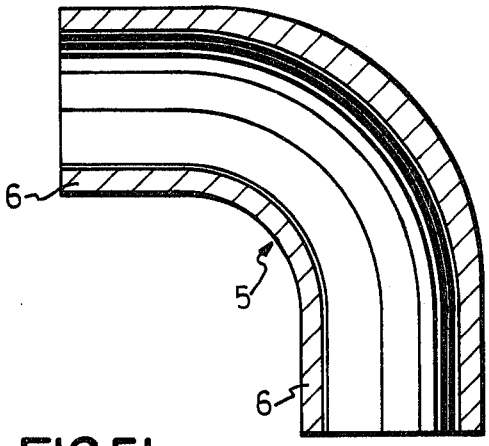
FIG. 3 represents a sectional view of a 90° elbow provided with straight tube portions at both ends thereof.

Now, as a preferred embodiment of this invention, manufacturing of a 90° elbow having straight tube portions 6 of an appropriate length provided at both ends thereof as shown in FIG. 3 is described. In the cast stock tube which is formed by casting or by machining the casting, according to a preferable method, as shown in FIG. 4, the bent tube portion 7 of the cast stock tube 5*a* is formed to the specified dimensions and shape of the elbow, while the straight tube portions 6*a* at both ends thereof are formed to have a larger diameter than the specified elbow dimension and a length somewhat shorter than that specified. It is desirable in forming such a stock tube to form tapered parts 8 which continuously join the in-and-out side surfaces of the straight tube portion 6*a* and the bent tube portion 7 at the boundary region between them, where each straight tube portion 6*a* is formed with a larger diameter, so that the straight tube portion 6*a* and the bent tube portion 7 are smoothly and contiguously formed, foreclosing failures such as fracture, etc., when the stock tube is subjected to the plastic deformation by contraction as later described.

Figure 5A:
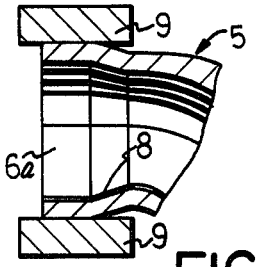

Thus, each straight tube portion 6*a* and tapered portion 8 of the cast stock tube 5*a* with each straight tube portion 6*a* at its end formed larger are subjected to a plastic deformation by way of contraction, thereby a tube with its end-portion plastic deformed is obtained, its straight tube portions 6*a* and tapered portions 8 nearly agreeing to the specified elbow dimensions and shape. Thus, the straight tube portion 6*a* at the end of the stock tube 5*a* is first pressured by means of pressing members 9, 9 from both sides as shown in FIG. 5*a;* the portion 6*a* is compressed flat, until the pressed surface is almost flush with the bent tube portion 7, thereby deforming the straight tube portion 6*a* and the tapered portion 8 into an elliptical shape. Thereafter, the straight tube portion 6*a* and the tapered portion 8 elliptically formed are pressured in the long diameter direction by means of a pair of half dies 10, 10 each having a semi-circular pressuring surface roughly corresponding to the bore of the elbow, the compression being applied until the dies come to meet each other. Thereby, the straight tube portion 6*a* and the tapered portion 8 of the stock tube 5*a* are plastic-deformed, roughly to the specified dimensions and shape, with their lengths in the axial direction and their thicknesses somewhat increased.

Figure 7:
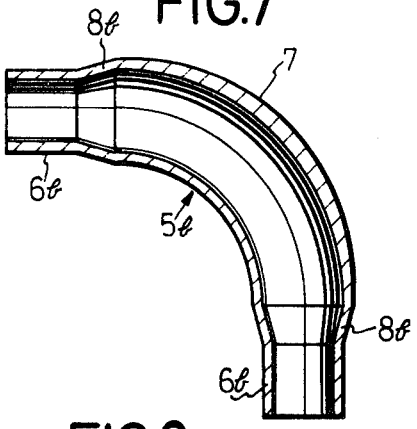
FIG. 7 displays a sectional view showing the shape of the stock tube from which the 90° elbow is formed by expansion.
Figure 8:
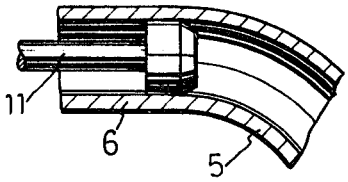
FIG. 8 exhibits a sectional view showing the way of forming the stock tube by expansion.
Figure 9:
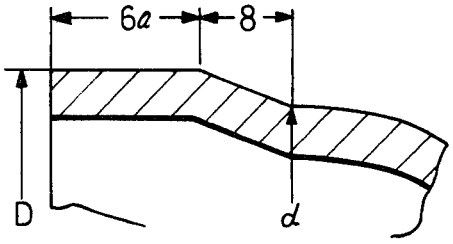
FIG. 9 portrays an enlarged sectional view of the straight tube portion of the stock tube.

In the foregoing, described is a method for obtaining an elbow with its ends plastic deformed in which a stock tube 5*a* having straight tube portions 6*a* formed at its ends with a diameter larger than the specified dimension is used, and it is formed by contraction. In another method for obtaining an elbow with its ends plastic deformed, a cast stock elbow tube 5*b* formed smaller in diameter than the specified dimension of the straight tube portions 6*b* at its ends as shown in FIG. 7 is employed. It is desirable in forming such a tube to provide tapered portions 8*b* in the neighborhood of the bent tube portion 7. In this instance, a process of expanding to the specified dimensions and shape the straight tube portions 6*b* at the ends and the tapered portions 8*b*, by pushing a plug 11 into the tube, for example, may be employed.

Thus, the first step in manufacturing an elbow 5 with straight tube portions 6 provided at both ends thereof, as shown in FIG. 3, by the method of this invention, is a process in which a cast stock tube 5*a*, 5*b* with bent portion 7 formed to the specified dimensions and shape, but with the straight tube portions at the ends 6*a*, 6*b* formed larger or smaller than the specified dimension is utilized, and the straight tube portions 6*a*, 6*b* and the tapered portions 8, 8*b* are subjected to respective plastic deformations, thereby forming the elbow with its ends plastic deformed roughly to the specified dimensions and shape of the elbow.

Whichever method is used, the degree of plastic deformation to which the straight tube portions 6*a*, 6*b* and the tapered portions 8, 8*b* of the cast stock tubes 5*a*, 5*b* are subjected should preferably be in the range of 10–50%. If the degree of deformation is less than 10%, adequate refinement of crystal grain can not be achieved by the heat treatment later described; and as a consequence, proper response to UT can not be ensured. As the degree of deformation is increased above 10%, a larger effect of crystal grain refinement may be achieved with growing degree of deformation. According to the method of this invention, however, an upper limit should be set at around 50%, because the straight tube portions 6*a*, 6*b* at the tube ends are subjected to a plastic deformation, both for preserving the quality at the ends, and for forming tapered parts 8, 8*b* between the bent tube part 7 being in its as-cast state and the straight tube portions 6*a*, 6*b*.

As described in the foregoing, the elbow with its ends plastic deformed which has been formed roughly to the specified shape and dimensions in the first step is subjected, as the second step, to the solution treatment doubling as the recrystallization heat treatment of heating at 1,000°-1,200° C. followed by quenching.

Thus, while it is a usual practice that stainless steels are subjected to the solution treatment in the aforementioned temperature range, according to the method of this invention, this treatment should effect the recrystallization heat treatment at the same time. If only the recrystallization treatment is intended, a temperature lower than 1,000° C. is enough for the heat treatment, but in order to have the concurrent effect of solution treatment, this treatment needs to be performed by heating the steel at a temperature at least above 1,000° C. Heating at over 1,200° C. is undesirable, however, because of the tendency of the crystal grain getting coarse at such high temperatures.

According to the method of this invention it is intended by way of such a solution treatment doubling as recrystallization heat treatment to attain an improvement in the straight tube portions 6*a*, 6*b* at both ends of the elbow formed in the first step with its ends plastic deformed to a fine structure having a grain size higher than at least 3, as represented by the ASTM number, of which description is made later in connection with an embodiment.

As for cast austenitic stainless steels used as the material of the cast stock tubes 5*a*, 5*b*, according to this invention, stainless steels not of a single phase of austenite, but particularly so adjusted as to have the ferrite phase mixed in in their structure in the proportion of 5–40%, need to be utilized.

As the cast 18-8 austenitic stainless steels, ASTM A3H CF8 (corresponding to AISI 304 of forged products) are the most common. Even the materials of this series are different in their chemical compositions and in their ferrite contents, as illustrated in the table below:

TABLE 1

Chemical compositions (% by weight) and ferrite contents in various austenitic stainless steels.

| | Test piece No. | Chemical composition C | Si | Mn | Cr | Ni | Fe | Ferrite content (%) | Manufacturing process |
|---|---|---|---|---|---|---|---|---|---|
| Controls | 1 | 0.07 | 0.61 | 1.81 | 18.1 | 8.5 | Balance | 0 | Forging |
| | 2 | 0.08 | 1.12 | 0.84 | 19.0 | 10.9 | " | 0 | Centrifugal casting |
| | 3 | 0.07 | 1.21 | 0.82 | 18.8 | 8.7 | " | 4 | Centrifugal casting |
| Materials used of this invention | 4 | 0.06 | 1.33 | 0.87 | 19.6 | 9.4 | " | 5 | Centrifugal casting |
| | 5 | 0.08 | 1.76 | 1.02 | 20.4 | 8.9 | " | 12 | Centrifugal casting |
| | 6 | 0.07 | 1.67 | 0.64 | 20.7 | 8.2 | " | 22 | Centrifugal casting |
| | 7 | 0.07 | 1.55 | 0.70 | 22.8 | 7.1 | " | 38 | Centrifugal casting |

Now, the IGC test with sulfuric acid and copper sulfate was conducted on various materials listed in Table 1, after they were subjected to the sensitization treatment at 650° C. for 0.2–100 hours; the results of Table 2 were obtained:

TABLE 2

Results of IGC test.

| | Test piece No. | Ferrite content (%) | Sensitizing time periods (hr) 0.2 | 0.5 | 1 | 5 | 10 | 100 |
|---|---|---|---|---|---|---|---|---|
| Controls | 1 | 0 | o | x | x | x | x | — |
| | 2 | 0 | o | x | x | x | x | — |
| | 3 | 4 | o | o | o | o | x | x |
| Materials use of this invention | 4 | 5 | o | o | o | o | o | o |
| | 5 | 12 | o | o | o | o | o | o |
| | 6 | 22 | o | o | o | o | o | o |
| | 7 | 38 | o | o | o | o | o | o |

Note:
The IGC test was conducted in accordance with ASTM A262 practice E. In this table, o mark indicates that no cracking occurred at the bending test performed after the corrosion test, and x mark shows that cracking occurred at the bending test carried out after the corrosion test.

Table 2 shows that the steels with ferrite content 0% (test piece Nos. 1 and 2), both cast steels and forged ones, become susceptible to IGC after 0.5 hours sensitization, and even the steel with ferrite content 4% (test piece No. 3) remains unsusceptible to IGC after 5 hours sensitization, but becomes liable to IGC after 10 hours sensitization. In contrast, the steels with ferrite contents in excess of 5% (test piece Nos. 4–7) shows such a marked improvement in their resistance to IGC as not being susceptible to IGC after 100 hours sensitization.

Based on the finding that a great improvement in the resistance to IGC can be achieved by including the ferrite phase in the steel in a proportion higher than 5%, the present invention proposes particularly the use as the stock materials of stainless steels (e.g., test piece Nos. 4–7) so adjusted as to have the ferrite phase mixed in the structure of austenite in the proportion of 5–40%, preferably 5–30%. The reason why the ferrite content is restricted to the upper limit of 40% is because above this level, the problem of reduced toughness of the material would arise.

According to the method of this invention described in connection with the manufacturing of an elbow 5 having straight tube portions 6 provided at both ends thereof, as the first step, a tube with its ends plastic deformed is obtained by subjecting the straight tube portions 6 at the ends and the tapered portions of the cast stock tube 5*a* to a plastic deformation, and as the second step, a heat treatment at a specified temperature range for the solution treatment as well as for the recrystallization treatment is applied to this tube, whereby the straight tube portions 6 at its ends are transformed to have a structure with fine crystal grain. Accordingly, when the elbow 1 manufactured by the method of this invention is welded to a straight pipe 3, the ISI by way of UT may be exercised at a high accuracy both from the side of the straight pipe 3 and from that of the elbow 1, for the obvious reason of the straight tube portion 2 being secured on the elbow side of the welding joint. While elbows made of steels being in a single phase of austenite are highly susceptible to the danger of IGC or SCC where they are exposed to welding heat. In this regard, safety is assured by the steels of this invention having the ferrite phase in the proportion of 5–40%, when used for the elbow material.

When the elbow has been manufactured by the method of this invention, the inspection for quality control of the elbow end portions (straight tube portions) may be conducted by way of UT, so that savings in cost and handling can be achieved, as compared with conventional cast products for which the X-ray test must be relied on.

In the following, preferred examples of this invention are described:

EXAMPLES

Figure 5B:
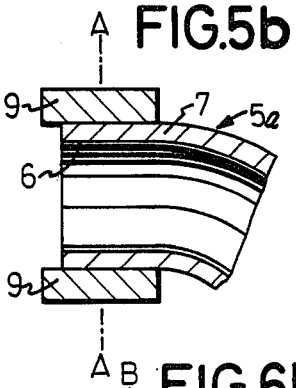
Figure 5C:
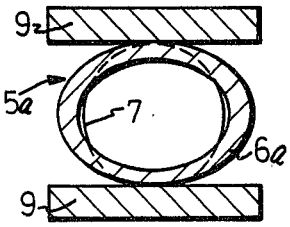
Figure 6A:
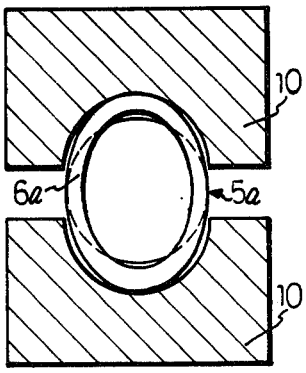
Figure 6B:
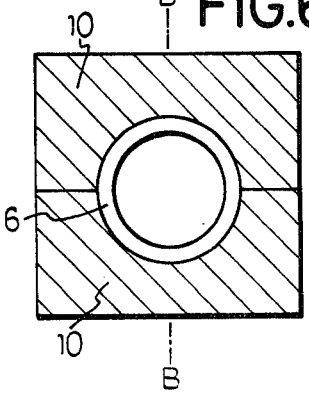
Figure 6C:
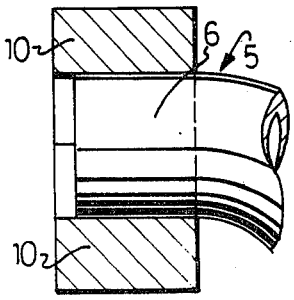

In manufacturing a 90° elbow (to be connected to a Schedule 80 pipe with 4 inch designated diameter) as shown in FIG. 3, a cast stock tube to form the elbow made of a cast stainless steel having the chemical composition listed in Table 3 below, which is in the shape of FIG. 4 was utilized, and by the method represented by FIGS. 5 and 6, an elbow with its ends plastic deformed which has dimensions roughly in agreement with the specified elbow dimensions was obtained. In this stock tube, the bore D of its straight tube portion 6*a* is made to be $D=d/0.8$, when d represents the elbow diameter, so that the degree of deformation $(D-d)/D \times 100$ (%) should be 20%. Thereafter, the aforementioned elbow with its ends plastic deformed was subjected to a heat treatment of holding the whole of the elbow at 1,100° C. for 1 hr, followed by water-cooling.

TABLE 3

| Chemical composition (% by weight). | | | | | | | | |
|---|---|---|---|---|---|---|---|---|
| C | Si | Mn | P | S | Cr | Ni | Mo | Ferrite* |
| 0.015 | 1.36 | 0.82 | 0.015 | 0.006 | 19.8 | 10.9 | 2.4 | 15% |

(Within the range of the rated compositions of ASTM A351 CF 3M.)
*Ferrite (%) gives the measured value obtained by use of a ferrite-scope.

Figure 10:
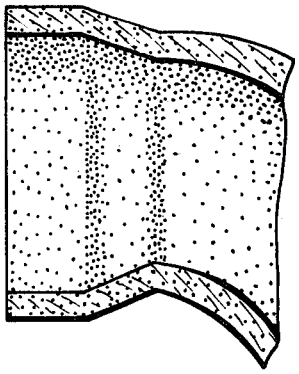
FIG. 10 registers a half-cut-sectional view of the elbow of the cast stock tube, showing in a section its crystal structure.
Figure 11:
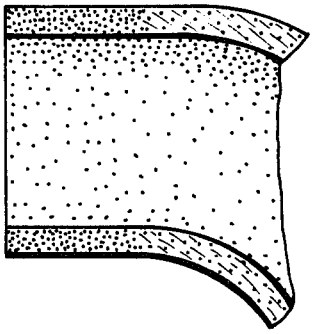
FIG. 11 reveals a half-cut-sectional view of the elbow after being formed, showing in a section its crystal structure.

Enlarged sections of the end portion of the 90° elbow manufactured in this way and that of the original cast stock tube, showing respective metals crystal structures, are on display in FIGS. 10 and 11.

The Figures show that in the 90° elbow manufactured by the method of this invention, the structure of the straight tube portion at its end is strikingly more refined, as compared with that in its original cast state. At the tapered portion formed adjacent the straight tube portion, because of a low degree of deformation, the degree of refinement is somewhat low. Results of direct measurements of the grain size of the crystal under a microscope revealed that the straight tube portion at the end produced about 1 in terms of the austenite grain size No. in its original cast state, but this figure went up to above 7 after the plastic deformation and recrystallization. Accordingly, the quality control inspection of products by way of UT which was hardly applicable to conventional castings may be performed on this elbow equally well as on forged products.

Figure 12:
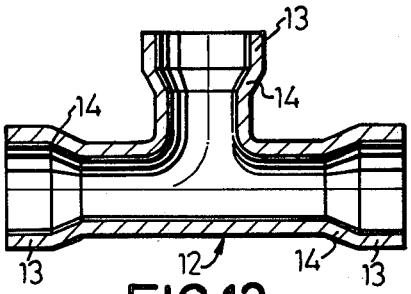
FIG. 12 manifests a sectional view of the shape of a cast stock tube of a T-pipe, showing another embodiment of this invention.
Figure 13:
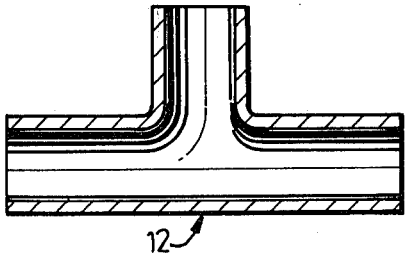
FIG. 13 indicates a sectional view showing the shape of the T-pipe after being formed.

While in the foregoing, the present invention has been described, with reference to an elbow as a preferred embodiment of the manufacturing method, this invention is equally successfully applicable to piping members having similar straight tube portions at their ends. For example, in forming a T-shape tube 12 as shown in FIG. 13, by the process of contraction, a cast stock tube 12 with the straight tube portions 3 at its ends formed larger in diameter as shown in FIG. 12 is used, and the T-shape tube with its end plastic deformed is, then, subjected to the specified heat treatment, whereby a T-shape tube with the straight tube portions at its ends having a fine crystalline structure is manufactured. In this application, it is also desirable that the tapered parts 14 should be formed between the straight tube portions 13 and the tube proper.

What is claimed as new and desired to be secured by Letters Patent of the United States is:

1. A manufacturing method of elbows made of cast stainless steels comprising the steps of providing a cast stock tube made of a cast austenitic stainless steel, with its chemical composition so adjusted as to have the ferrite phase mixed in the proportion of 5–40%, and with straight tube portions at its ends formed larger or smaller than a final dimension, subjecting said tube to a process of contraction or expansion at said straight tube portions at its ends, thereby obtaining a tube formed roughly to said final dimension with its ends plastic deformed, and subjecting said tube with its ends plastic deformed to a heat treatment of heating at 1,000°–1,200° C. followed by quenching.

2. A method according to claim 1 wherein in the process of contraction, a straight tube portion at the end of the stock tube formed with a larger diameter than said final dimension is plastic deformed to an elliptical shape by compressing the tube by means of pressing members, until the lesser diameter of said ellipse diameter becomes equal to said final dimension; then, the greater diameter of said ellipse is plastic deformed to the specified dimension by means of half dies each in the shape of a semi-circle.

3. A method according to claim 1 wherein in the process of expansion, the straight tube portion at the end formed with a smaller diameter than said final dimension is expanded to said final dimension by pushing a plug into said portion.

4. A method according to claim 1 wherein the straight tube portion at both ends and the remainder of the cast stock tube are connected by tapered portions.

5. A method according to claim 1 wherein the cast stock tube is in T-shape.

* * * * *